US006712871B2

(12) United States Patent
Oh

(10) Patent No.: US 6,712,871 B2
(45) Date of Patent: Mar. 30, 2004

(54) SINTERED ALLOY FOR VALVE SEAT HAVING EXCELLENT WEAR RESISTANCE AND METHOD FOR PRODUCING THE SAME

(75) Inventor: Jung Seok Oh, Kyungki-do (KR)

(73) Assignee: Hyundai Motor Company, Seoul (KR)

( * ) Notice: Subject to any disclaimer, the term of this patent is extended or adjusted under 35 U.S.C. 154(b) by 12 days.

(21) Appl. No.: 10/231,383

(22) Filed: Aug. 29, 2002

(65) Prior Publication Data

US 2003/0097904 A1 May 29, 2003

(30) Foreign Application Priority Data

Sep. 10, 2001 (KR) ..... 10-2001-0055483

(51) Int. Cl.[7] ..... B22F 3/14; C22C 1/05

(52) U.S. Cl. ..... 75/239; 75/236; 75/243; 75/246; 419/14; 419/27; 419/29; 419/48

(58) Field of Search ..... 75/236, 239, 243, 75/246; 419/14, 27, 29, 48

(56) References Cited

U.S. PATENT DOCUMENTS 4,363,662 A * 12/1982 Takahashi et al. ..... 75/243
5,031,878 A * 7/1991 Ishikawa et al. ..... 251/368
5,080,713 A * 1/1992 Ishibashi et al. ..... 75/246
5,106,576 A * 4/1992 Noda et al. ..... 419/8
5,498,483 A * 3/1996 Ito et al. ..... 428/552
5,529,602 A * 6/1996 Ishii et al. ..... 75/231
5,870,989 A * 2/1999 Takahashi et al. ..... 123/188.3
6,139,598 A * 10/2000 Narasimhan et al. ..... 75/246

* cited by examiner

*Primary Examiner*—Ngoclan Mai
(74) *Attorney, Agent, or Firm*—Morgan Lewis & Bockius LLP

(57) ABSTRACT

A sintered alloy composition for automotive engine valve seats, and a method for producing the same, are described. An iron base sintered alloy composition comprising vanadium carbide particles, Fe—Co—Ni—Mo alloy particles, and Cr—W—Co—C alloy particles in which the composition is dispersed in a structure of sorbite is particularly suitable for use as materials of valve seats for automotive engines which requires excellent wear resistance, high-performance, high-rotation-speed, and low-fuel-consumption.

25 Claims, No Drawings

SINTERED ALLOY FOR VALVE SEAT HAVING EXCELLENT WEAR RESISTANCE AND METHOD FOR PRODUCING THE SAME

FIELD OF THE INVENTION

The present invention relates to a sintered alloy for valve seat having excellent wear resistance and a method for producing the same. More particularly, it relates to an iron base sintered alloy comprising vanadium carbide(VC) particles, Fe—Co—Ni—Mo alloy particles and Cr—W—Co—C alloy particles in which the composition is dispersed in a structure of sorbite and a method for producing the same, thus being suitable for use as materials of valve seats for automotive engines which requires excellent wear resistance, high-performance, high-rotation-speed and low-fuel-consumption.

BACKGROUND OF THE INVENTION

A valve seat for an automotive engine, which is an engine part to increase thermal efficiency of a combustion chamber, is required to have high heat resistance, high wear resistance and high oxidation resistance at a temperature of from 400° C. to 700° C. to suffer from contact, friction, exposure to exhaust gas during the operation of the internal combustion engine.

Methods for producing valve seats of automotive engines are an infiltration process, a hard metal addition process, a control of alloy composition and the like.

An infiltration is the process of filling pores of a sintered alloy material with infiltrating materials such as Cu, and Cu—Pd, or solid lubricants such as Pb, PbO, $B_2O_3$, ZnO and the like and thus it improves ductility and machinability when valves are rotating.

A hard metal addition is the process of producing a sintered alloy containing hard Fe—Mo, or Co—Ni—W—C carbide complex having about 300 $\mu$m of size. The sintered alloy containing hard carbide complex improves wear resistance by dispersing heavy loading to valve seat through hard carbides having excellent wear resistance when valves are rotating. However, it has several disadvantages such as poor machinability, and use of a large quantity of expensive Co, Ni, W which increases total manufacturing cost.

A control of alloy composition is the process of mixing alloy components as elemental powder, and then melting the powders to form an alloy of a certain composition. It is low in price and easy to produce but difficult to obtain homogeneous structure. Metals such as Co, Ni, Mo, Cr, W and the like are usually used and a large quantity of Co is used to increase thermal stability.

A conventional process of producing sintered alloy includes the steps of mixing each component, compacting the mixture, sintering the compacted mixture, copper infiltration into the sintered mixture, followed by heat treatment. This is a known powder metallurgy manufacturing process. In this process for manufacturing a sintered alloy for a valve seat, Co—Mo—Cr alloy powder or Co—Ni—W—C alloy powder is added to Fe powder to improve wear resistance. However, the sintered alloy produced by this method still has unsatisfied wear resistance to use as materials for valve seats of engines which requires high-performance and high-rotation-speed.

In order to reduce abrasion of valve seat, a gasoline containing 0.2 to 0.8 g/gallon of tetraethyl lead has been used as an anti-knocking agent by increasing octane number. This anti-knocking agent also formed a lubricating film between valve and valve seat by producing lead oxide or lead compound after combustion. However, it is recently a compulsory regulation to use unleaded gasoline containing not higher than 0.004 g/gallon of tetraethyl lead due to serious pollution associated with carbon monoxide, carbon dioxide and lead. It is, therefore, highly desirable to provide novel materials for valve seats of automotive engines having an improved wear resistance compared to the conventional ones.

SUMMARY OF THE INVENTION

The inventors have developed a sintered alloy composition for valve seats having an improved wear resistance to satisfy the requirements for engines to suffer from high output, high rotation and low fuel consumption.

The present invention relates to a sintered alloy composition for valve seats having excellent wear resistance, homogeneous sintered structure and cost effectiveness, in which vanadium carbide particles, Fe—Co—Ni—Mo alloy particles and Cr—W—Co—C alloy particles are dispersed in a structure of sorbite.

In one embodiment, the invention relates to a sintered alloy comprising:

between about 0.7 to about 1.3 weight % of vanadium carbide particles;

between about 84 to about 86 weight % of Fe—Co—Ni—Mo alloy particles; and between about 12.5 to about 13.5 weight % of Cr—W—Co—C alloy particles.

The sintered alloy may further include between about 0.6 to about 1.3 weight % of added carbon, wherein the particles are dispersed in a structure of sorbite. The Fe—Co—Ni—Mo alloy powder advantageously comprises about 86 to about 93 weight % of Fe; about 5 to about 8 weight % of Co; about 1 to about 3 weight % of Ni; and about 1 to about 3 weight % of Mo. The Cr—W—Co—C alloy powder advantageously comprises about 48 to about 80 weight % of Cr; about 8 to about 25 weight % of W; about 10 to about 25 weight % of Co; and about 1 to about 3 weight % of C. The sintered alloy advantageously further includes between about 11 to about 18 weight % of added infiltrating material. The infiltrating material advantageously includes copper. The infiltrating material may in one embodiment be selected from the group consisting of Cu, a Cu—Pd alloy, Pb, PbO, $B_2O_3$, ZnO, or mixtures thereof. The sintered alloy advantageously further includes added carbon, for example added in the form of graphite particles. Advantageously, the Fe—Co—Ni—Mo alloy powder consists essentially of about 86 to about 93 weight % of Fe; about 5 to about 8 weight % of Co; about 1 to about 3 weight % of Ni; and about 1 to about 3 weight % of Mo; and the Cr—W—Co—C alloy powder consists essentially of about 48 to about 80 weight % of Cr; about 8 to about 25 weight % of W; about 10 to about 25 weight % of Co; and about 1 to about 3 weight % of C. The sintered alloy composition is:

between about 1 to about 1.5 weight % of C;

between about 1 to about 3 weight % of Ni;

between about 6 to about 11 weight % of Cr;

between about 1 to about 3 weight % of Mo;

between about 5 to about 11 weight % of Co;

between about 1 to about 3 weight % of W;

between about 0.5 to about 1.0 weight % of V;

between about 11 to about 18 weight % of Cu; and the balance Fe.

Advantageously, a valve seat for automotive engines is machined from the sintered alloy.

In another embodiment, the sintered alloy includes:

at least about 0.7 weight % of metal-carbide particles;

Fe—Co—Ni—Mo alloy particles, wherein the Fe—Co—Ni—Mo alloy particles contain an alloy comprising about 86 to about 93 weight % of Fe, about 5 to about 8 weight % of Co, about 1 to about 3 weight % of Ni, and about 1 to about 3 weight % of Mo;

at least 11.5 weight % of Cr—W—Co—C alloy particles, wherein the Cr—W—Co—C alloy particles contain an alloy comprising about 48 to about 80 weight % of Cr, about 8 to about 25 weight % of W, about 10 to about 25 weight % of Co, and about 1 to about 3 weight % of C, wherein the metal-carbide particles, Fe—Co—Ni—Mo alloy particles, and Cr—W—Co—C alloy particles are mixed and then are sintered into a substantially homogeneous porous structure; and an infiltrating material disposed in the porous structure.

The sintered alloy advantageously further includes between about 0.6 to about 1.3 weight % of added carbon. The sintered particles are dispersed in a structure of sorbite, and the infiltrating material is advantageously Cu. The infiltrating material in one embodiment is selected from the group consisting of Cu, a Cu—Pd alloy, Pb, PbO, $B_2O_3$, ZnO, or mixtures thereof. Advantageously, the metal-carbide comprises vanadium carbide. In one embodiment, the sintered alloy had added carbon that was added in the form of graphite particles which were sintered into the sorbite structure, and the sintered alloy includes between about 11 to about 18 weight % of infiltrating material.

The invention also relates to a method for producing the sintered alloy for valve seat comprising the steps of:

mixing 84 to 86 weight % of Fe—Co—Ni—Mo alloy powder, 12.5 to 13.5 weight % of Cr—W—Co—C alloy powder, 0.7 to 1.3 weight % of vanadium carbide powder, and 0.6 to 1.3 weight % of graphite powder to form a substantially homogeneous mixture;

applying pressure and heat to the substantially homogeneous mixture in amounts sufficient to sinter the substantially homogeneous mixture into a porous sintered composition;

infiltrating with an infiltration material to form an infiltrated sintered alloy; and quenching the infiltrated sintered alloy.

The method advantageously includes a surface pressure of from 5 to 8 ton/cm$^2$ applied prior to and/or during sintering, and advantageously the sintering is performed at a temperature of from about 1160° C. to about 1200° C. under a reductive atmosphere. The reductive atmosphere advantageously includes ammonium gas, cracked ammonia gas, or a mixture thereof. The infiltrating material advantageously comprises copper, and the infiltration temperature is advantageously between about 1080° C. to about 1100° C. The quenching comprises oil quenching at a temperature of from about 850° C. to about 880° C. for 30 to 45 minutes. The method further advantageously includes tempering the quenched sintered alloy, wherein the tempering comprises maintaining the sintered alloy at a temperature of from about 590° C. to about 610° C. The substantially homogenous mixture in one embodiment further comprises iron or an iron alloy different than the Fe—Co—Ni—Mo alloy powder, wherein the iron or an iron alloy form on sintering a sorbite structure with the Fe—Co—Ni—Mo alloy powder, Cr—W—Co—C alloy powder, vanadium carbide powder, and graphite powder dispersed therein. The sintered alloy advantageously comprises:

Fe, between about 1.0 to about 1.5 weight % of C, between about 1 to about 3 weight % of Ni, between about 6 to about 11 weight % of Cr, between about 1 to about 3 weight % of Mo, between about 5 to about 11 weight % of Co, between about 1 to about 3 weight % of W, between about 0.5 to about 1.0 weight % of V, and between about 11 to about 18 weight % of an infiltrating material comprising Cu.

Advantageously, the Fe—Co—Ni—Mo alloy particles contain an alloy comprising about 86 to about 93 weight % of Fe, about 5 to about 8 weight % of Co, about 1 to about 3 weight % of Ni, and about 1 to about 3 weight % of Mo.

Advantageously, the Cr—W—Co—C alloy particles contain an alloy comprising about 48 to about 80 weight % of Cr, about 8 to about 25 weight % of W, about 10 to about 25 weight % of Co, and about 1 to about 3 weight % of C.

Advantageously, a surface pressure of from 5 to 8 ton/cm$^2$ is applied prior to and/or during sintering, and the sintering is performed at a temperature of from about 1160° C. to about 1200° C. under a reductive atmosphere comprising ammonium gas, cracked ammonia gas, or a mixture thereof.

Advantageously, the infiltrating material comprises copper, and the infiltration temperature is between about 1080° C. to about 1100° C.

Advantageously, the quenching comprises oil quenching at a temperature of from about 850° C. to about 880° C. for 30 to 45 minutes.

Advantageously, the method further includes tempering the quenched sintered alloy, wherein the tempering comprises maintaining the sintered alloy at a temperature of at least about 590° C. for at least about 2 hours.

DETAILED DESCRIPTION OF THE INVENTION

In one embodiment, the present invention is a sintered alloy for valve seats prepared by dispersing:

0.7 to 1.3 weight % of a vanadium carbide powder;

84 to 86 weight % of a Fe—Co—Ni—Mo alloy powder;

12.5 to 13.5 weight % of a Cr—W—Co—C alloy powder; and 0.6 to 1.3 weight % of graphite powder in a structure of sorbite.

In one embodiment, the sintered alloy of the present invention is prepared by dispersing vanadium carbide particles, Fe—Co—Ni—Mo alloy particles and Cr—W—Co—C alloy particles in a structure of sorbite. In another embodiment, the present invention relates to the above-described alloys into which an infiltrating material is caused to infiltrate.

In one embodiment, the present invention is an alloy prepared by mixing, sintering, and heat treating a composition containing: 0.7 to 1.3 weight % of a vanadium carbide powder; 84 to 86 weight % of a base alloy that is a Fe—Co—Ni—Mo alloy powder; 12.5 to 13.5 weight % of a Cr—W—Co—C alloy powder; and 0.6 to 1.3 weight % of graphite powder. In one embodiment, the sintered alloy of the present invention is prepared by dispersing vanadium carbide particles, Fe—Co—Ni—Mo alloy particles and Cr—W—Co—C alloy particles in a structure of sorbite. In another embodiment, the present invention relates to the above-described alloy into which an infiltrating material is caused to infiltrate.

The present invention also relates to a method for producing the sintered alloy for valve seats comprising the steps of: mixing a Fe—Co—Ni—Mo base alloy powder, a Cr—W—Co—C alloy powder, a vanadium carbide powder, and a graphite powder; sintering the mixture under the reductive atmosphere; adding an infiltrating material; and tempering.

The present invention also relates to a method for producing the sintered alloy for valve seats comprising the steps of: mixing a Fe—Co—Ni—Mo alloy powder, a Cr—W—Co—C alloy powder, a vanadium carbide powder, and a graphite powder with a composition comprising sorbite; sintering the mixture under the reductive atmosphere; adding an infiltrating material; and tempering.

In one embodiment, the sintered alloy of the present invention is prepared by dispersing vanadium carbide particles, Fe—Co—Ni—Mo alloy particles and Cr—W—Co—C alloy particles substantially homogenously in a structure of sorbite.

The present invention also relates to a method for producing the sintered alloy for valve seats comprising the steps of:

mixing 84 to 86 weight % of Fe—Co—Ni—Mo alloy powder, 12.5 to 13.5 weight % of Cr—W—Co—C alloy powder, 0.7 to 1.3 weight % of vanadium carbide powder, and 0.6 to 1.3 weight % of graphite powder;

applying a surface pressure of from 5 to 8 ton/cm$^2$;

sintering at a temperature of from 1160° C. to 1200° C. under the reductive atmosphere containing ammonium gas;

infiltrating with an infiltration material, for example copper, at a temperature of from 1080° C. to 1100° C. and oil quenching at a temperature of from 850° C. to 880° C. for 30 to 45 minutes; and tempering at a temperature of from 590° C. to 610° C.

In some embodiments, other components, such as particles containing Fe—Mo, Co—Ni—W—C, Co—Mo—Cr, and the like can be added. In the preferred embodiment, however, the sintered alloy is prepared by dispersing vanadium carbide particles, Cr—W—Co—C alloy particles, and optionally graphite particles, in a base of Fe—Co—Ni—Mo alloy particles which on sintering forms a sorbite structure.

Unlike conventional sintered alloys, in the preferred embodiments of this invention the sintered alloy requires use of alloys mixed with Fe instead of using individual Fe, Ni, Mo, and Co powder to provide homogenous structure by preventing from local segregation associated with the conventional sintered alloys.

In one embodiment, the invention comprises a sintered alloy containing a Fe—Co—Ni—Mo alloy powder. The Fe—Co—Ni—Mo alloy powder comprises:

86 to 93 weight %, for example 89 to 90 weight %, of Fe;

5 to 8 weight %, for example 6 to 7 weight %, of Co;

1 to 3 weight %, for example 1.5 to 2.5 weight %, of Ni; and 1 to 3 weight %, for example 1.5 to 2.5 weight %, of Mo.

In one embodiment, the invention comprises a sintered alloy containing a Cr—W—Co—C alloy powder. The Cr—W—Co—C alloy powder comprises:

48 to 80 weight %, for example 60 to 70 weight %, of Cr;

8 to 25 weight %, for example 12 to 20 weight %, of W;

10 to 25 weight %, for example 15 to 20 weight %, of Co; and 1 to 3 weight %, for example 1.5 to to 2.5 weight %, of C.

In one embodiment, the invention comprises a sintered alloy containing a Fe—Co—Ni—Mo alloy powder, a Cr—W—Co—C alloy powder, and a metal carbide powder. Metal carbides useful in the present invention include for example vanadium carbide, silicon carbide, tungsten carbide, molybdenum carbide, and mixtures thereof. Vanadium carbide is preferred.

In a preferred embodiment of the present invention, the Fe—Co—Ni—Mo alloy powder is preferably in a range of from 84 to 86 weight % against the total of the sintered alloy. If the amount is deviated from this range, the sintered alloy becomes inferior in wear resistance.

The Cr—W—Co—C alloy powder is preferably in a range of from 12.5 to 13.5 weight % against the total of the sintered alloy to improve the wear resistance by dispersing in the substrate structure. If the amount is less than 12.5 weight %, the sintered alloy becomes inferior in wear resistance. On the other hand if it is greater than 13.5 weight %, it is disadvantageous in cost.

The metal carbide powder is advantageously vanadium carbide. Vanadium is added as vanadium carbide powder to improve wear resistance by dispersing in the substrate structure. The vanadium carbide powder is preferably in a range of from 0.7 to 1.3 weight % against the total of the sintered alloy. If the amount is less than 0.7 weight %, it does not sufficiently improve wear resistance. On the other hand if it is greater than 1.3 weight %, it is disadvantageous in cost.

Advantageously the composition also includes graphite powder. The graphite powder is preferably in a range of from 0.6 to 1.3 weight % against the total of the sintered alloy. If the amount is less than 0.6 weight %, it does not affect to increase hardness. On the other hand if it is greater than 1.3 weight %, it becomes low in hardness.

An infiltrating material, for example copper, is added in a quantity up to the total amount that can be made to infiltrate the alloy. This amount will depend on the porosity and composition of the sintered particles.

Accordingly, in one embodiment an overall composition of the sintered alloy comprises 1.0 to 1.5 weight % of C, 1 to 3 weight % of Ni, 6 to 11 weight % of Cr, 1 to 3 weight % of Mo, 5 to 11 weight % of Co, 1 to 3 weight % of W, 0.5 to 1.0 weight % of V, 11 to 18 weight % of an infiltrating material, for example Cu, and balance consisting of Fe.

The sintered alloy for valve seats of the present invention is prepared by:

mixing the above powdered composition;

advantageously applying a surface pressure of from 5 to 8 ton/cm$^2$ to have a compacting density of 6.8 g/cm$^2$;

sintering, advantageously at a temperature of from 1160° C. to 1200° C. for 1 hour, and advantageously under the reductive atmosphere containing for example cracked ammonium gas;

infiltrating with an infiltrating material, for example a copper-containing infiltration material, advantageously at a temperature of from 1080° C. to 1100° C., advantageously oil quenching at a temperature of for example from 850° C. to 880° C. for 30 to 45 minutes; and advantageously tempering, for example at a temperature of from 590° C. to 610° C.

EXAMPLES

The following Examples are intended to further illustrate the present invention without limiting its scope. The compositions of Examples 1 and 2, along with the compositions of Comparative Examples 3 to 5, are shown in Table 1. Abrasive test data of Examples 1 and 2, along with the comparative data from Comparative Examples 3 to 5, are shown in Table 2.

Example 1

The sintered alloy for valve seat was produced by mixing Fe—Co—Ni—Mo alloy powder, Cr—W—Co—C alloy powder, vanadium carbide powder, and graphite to be the overall composition comprising 1.3 weight % of C, 2.0 weight % of Ni, 8.0 weight % of Cr, 2.0 weight % of Mo, 6.5 weight % of Co, 15 weight % of Cu, 2.0 weight % of W, 0.8 weight % of V and balance of Fe as shown in Table 1. The mixed powder was compacted and then sintered at a temperature of 1180° C. under the reductive condition containing cracked ammonium gas for 1 hour. Copper infiltration was performed at a temperature of 1190° C. for 30 minutes and a quenching at 870° C. for 40 minutes, followed by a tempering at a temperature of 600° C. for 2 hours to produce the desired sintered alloy.

Example 2

The sintered alloy for valve seat was produced by mixing Fe—Co—Ni—Mo alloy powder, Cr—W—Co—C alloy powder, vanadium carbide powder, and black lead to be the overall composition comprising 1.1 weight % of C, 2.0 weight % of Ni, 6.8 weight % of Cr, 2.0 weight % of Mo, 5.5 weight % of Co, 15 weight % of Cu, 1.8 weight % of W, 0.6 weight % of V and balance of Fe as shown in Table 1. The mixed powder was compacted and then sintered at a temperature of 1180° C. under the reductive condition containing cracked ammonium gas for 1 hour. Copper infiltration was performed at a temperature of 1190° C. for 30 minutes and a quenching at 870° C. for 40 minutes, followed by a tempering at a temperature of 600° C. for 2 hours to produce the desired sintered alloy.

Comparative Example 3

The comparative sintered alloy for valve seat was produced by mixing Co—Mo—Cr and Fe—Cr—W—Co—C alloy powder to Fe—Cr—Mn—Mo alloy powder to be the overall composition comprising 1.3 weight % of C, 2.0 weight % of Ni, 7.5 weight % of Cr, 2.0 weight % of Mo, 6.5 weight % of Co, 2.0 weight % of W, 0.7 weight % of Mn, 15 weight % of Cu, and balance of Fe as shown in Table 1. The mixed powder was compacted and then sintered at a temperature of 1160° C. under the reductive condition containing cracked ammonium gas for 1 hour. Copper infiltration was performed and then a quenching at 920° C. for 1 hour, followed by a tempering at a temperature of 600° C. for 2 hours to produce the comparative sintered alloy.

Comparative Example 4

The comparative sintered alloy for valve seat was produced by mixing Co—Mo—Cr alloy powder and W, Co, black lead to Fe—Cr—Mn—Mo powder to be the overall composition comprising 1.1 weight % of C, 2.0 weight % of Ni, 6.5 weight % of Cr, 2.0 weight % of Mo, 8.0 weight % of Co, 1.5 weight % of W, 0.7 weight % of Mn, 15 weight % of Cu, and balance of Fe as shown in Table 1. The mixed powder was compacted and then sintered at a temperature of 1160° C. under the reductive condition containing cracked ammonium gas for 1 hour. Copper infiltration was performed and then a quenching at 920° C. for 1 hour, followed by a tempering at a temperature of 600° C. for 2 hours to produce the comparative sintered alloy.

Comparative Example 5

The comparative sintered alloy for valve seat was produced by mixing Fe—Ni—Mo alloy powder, C—Cr—Co—W—Fe alloy powder, Co, Ferro vanadium (Fe—V), black lead to be the overall composition comprising 1.1 weight % of C, 2.0 weight % of Ni, 7.5 weight % of Cr, 2.0 weight % of Mo, 7.0 weight % of Co, 2.2 weight % of W, 0.8 weight % of V, 15 weight % of Cu, and balance of Fe as shown in Table 1. The mixed powder was compacted and then sintered at a temperature of 1160° C. under the reductive condition containing cracked ammonium gas for 1 hour. Copper infiltration was performed and then a quenching at 870° C. for 1 hour, followed by a tempering at a temperature of 650° C. for 2 hours to produce the comparative sintered alloy.

TABLE 1

| | Component (weight %) | | | | | | | | | |
|---|---|---|---|---|---|---|---|---|---|---|
| Category | C | Ni | Cr | Mo | Co | Mn | W | V | Cu | Fe |
| Ex. 1 | 1.3 | 2.0 | 8.0 | 2.0 | 6.5 | — | 2.0 | 0.8 | 15 | balance |
| Ex. 2 | 1.1 | 2.0 | 6.8 | 2.0 | 5.5 | — | 1.8 | 0.6 | 15 | balance |
| Com. Ex. 3 | 1.3 | 2.0 | 7.5 | 2.0 | 6.5 | 0.7 | 2.0 | — | 15 | balance |
| Com. Ex. 4 | 1.1 | 2.0 | 6.5 | 2.0 | 8.0 | 0.7 | 1.5 | — | 15 | balance |
| Com. Ex. 5 | 1.1 | 2.0 | 7.5 | 2.0 | 7.0 | — | 2.2 | 0.8[(1)] | 15 | balance |

[(1)]Vanadium used in Comparative Example 5 was Ferro vanadium (Fe-V)

Experimental Example: Wear Test

A pin-on-disc wear test was carried out on the sintered prepared in Examples and Comparative Examples under the conditions of rotation, sliding speed of 2.5 m/sec, sliding distance of 30 km, applied load of 20 lb and disc temperature of 150° C. The sintered alloys prepared in Examples and Comparative Examples were used as pin material, and heat resistant steel SUH35 as disc material. The results are summarized in Table 2.

TABLE 2

| Category | Amount of pin abrasion | Amount of disc abrasion |
|---|---|---|
| Example 1 | 0.1213 g | 0.0113 g |
| Example 2 | 0.1236 g | 0.0124 g |
| Comparative Example 3 | 0.1377 g | 0.0137 g |
| Comparative Example 4 | 0.1419 g | 0.0145 g |
| Comparative Example 5 | 0.1335 g | 0.0125 g |

In a pin abrasion test, it is advantageous to have less pin abrasion and may also be advantageous to also have less disc abrasion. Compared with the Comparative Examples 3 to 5, wear resistance of the sintered alloys according to the Examples 1 and 2 of the present invention is improved. The overall composition of Example 1 and Comparative Examples 3 and 5 are similar. The sintered alloy according to the Example 1 exhibited pin abrasion loss about 13% less than the Comparative Example 3, and, compared with Comparative Example 5 which used Fe—V, pin abrasive loss was reduced by about 10%. The overall composition of Example 2 and Comparative Examples 4 and 5 are similar. The sintered alloy according to the Example 2 exhibited pin abrasion loss about 13% less than the Comparative Example 4, and about 7% less compared with Comparative Example 5 which used Fe—V.

The abrasive wear on the disk was also less for Examples 1 and 2 compared with Comparative Examples 3 to 5.

As described above, the sintered alloy for valve seat of the present invention exhibits excellent wear resistance and homogeneous structure and thus, it is well suitable as materials of valve seats for automotive engines which requires excellent wear resistance, high-performance, high-rotation-speed, and low-fuel-consumption.

The invention as is described above is not intended to be limited by the values and combinations shown, but is intended to encompass all subject matter within the claims below.

What is claimed is:

1. A sintered alloy comprising:

between about 0.7 to about 1.3 weight % of vanadium carbide particles;

between about 84 to about 86 weight % of Fe—Co—Ni—Mo alloy particles; and between about 12.5 to about 13.5 weight % of Cr—W—Co—C alloy particles.

2. The sintered alloy of claim 1 further comprising between about 0.6 to about 1.3 weight % of added carbon, wherein the particles are dispersed in a structure of sorbite.

3. The sintered alloy of claim 1, wherein the Fe—Co—Ni—Mo alloy powder comprises about 86 to about 93 weight % of Fe; about 5 to about 8 weight % of Co; about 1 to about 3 weight % of Ni; and about 1 to about 3 weight % of Mo.

4. The sintered alloy of claim 1, wherein the Cr—W—Co—C alloy powder comprises about 48 to about 80 weight % of Cr; about 8 to about 25 weight % of W; about 10 to about 25 weight % of Co; and about 1 to about 3 weight % of C.

5. The sintered alloy of claim 1 further comprising between about 11 to about 18 weight % of added infiltrating material.

6. The sintered alloy of claim 2 wherein the added carbon was added in the form of graphite particles, the sintered alloy further comprising between about 11 to about 18 weight % of added infiltrating material.

7. The sintered alloy of claim 5 wherein the infiltrating material comprises copper.

8. The sintered alloy of claim 5 wherein the infiltrating material is selected from the group consisting of Cu, a Cu—Pd alloy, Pb, PbO, $B_2O_3$, ZnO, or mixtures thereof.

9. The sintered alloy of claim 1, wherein the Fe—Co—Ni—Mo alloy powder consists essentially of about 86 to about 93 weight % of Fe; about 5 to about 8 weight % of Co; about 1 to about 3 weight % of Ni; and about 1 to about 3 weight % of Mo; and wherein the Cr—W—Co—C alloy powder consists essentially of about 48 to about 80 weight % of Cr; about 8 to about 25 weight % of W; about 10 to about 25 weight % of Co; and about 1 to about 3 weight % of C.

10. The sintered alloy of claim 9, wherein the composition of said sintered alloy is:

between about 1 to about 1.5 weight % of C;

between about 1 to about 3 weight % of Ni;

between about 6 to about 11 weight % of Cr;

between about 1 to about 3 weight % of Mo;

between about 5 to about 11 weight % of Co;

between about 1 to about 3 weight % of W;

between about 0.5 to about 1.0 weight % of V;

between about 11 to about 18 weight % of Cu; and the balance Fe.

11. A valve seat for automotive engines comprising the sintered alloy of claim 10.

12. A sintered alloy comprising:

at least about 0.7 weight % of metal-carbide particles;

Fe—Co—Ni—Mo alloy particles, wherein the Fe—Co—Ni—Mo alloy particles contain an alloy comprising about 86 to about 93 weight % of Fe, about 5 to about 8 weight % of Co, about 1 to about 3 weight % of Ni, and about 1 to about 3 weight % of Mo; and at least 11.5 weight % of Cr—W—Co—C alloy particles, wherein the Cr—W—Co—C alloy particles contain an alloy comprising about 48 to about 80 weight % of Cr, about 8 to about 25 weight % of W, about 10 to about 25 weight % of Co, and about 1 to about 3 weight % of C, wherein the metal-carbide particles, Fe—Co—Ni—Mo alloy particles, and Cr—W—Co—C alloy particles are mixed and then are sintered into a substantially homogeneous porous structure; and an infiltrating material disposed in the porous structure.

13. The sintered alloy of claim 12 further comprising between about 0.6 to about 1.3 weight % of added carbon.

14. The sintered alloy of claim 13 wherein the sintered particles are dispersed in a structure of sorbite, and wherein the infiltrating material is Cu.

15. The sintered alloy of claim 13, wherein the infiltrating material is selected from the group consisting of Cu, a Cu—Pd alloy, Pb, PbO, $B_2O_3$, ZnO, or mixtures thereof, and wherein the metal-carbide comprises vanadium carbide.

16. The sintered alloy of claim 14 wherein the added carbon was added in the form of graphite particles which were sintered into the sorbite structure, and the sintered alloy comprises between about 11 to about 18 weight % of infiltrating material.

17. A method for producing the sintered alloy for valve seat comprising the steps of:

mixing 84 to 86 weight % of Fe—Co—Ni—Mo alloy powder, 12.5 to 13.5 weight % of Cr—W—Co—C alloy powder, 0.7 to 1.3 weight % of vanadium carbide powder, and 0.6 to 1.3 weight % of graphite powder to form a substantially homogeneous mixture;

applying pressure and heat to the substantially homogeneous mixture in amounts sufficient to sinter the substantially homogeneous mixture into a porous sintered composition;

infiltrating with an infiltration material to form an infiltrated sintered alloy; and quenching the infiltrated sintered alloy.

18. The method of claim 17 wherein a surface pressure of from 5 to 8 ton/cm$^2$ is applied prior to and/or during sintering, and wherein the sintering is performed at a temperature of from about 1160° C. to about 1200° C. under a reductive atmosphere.

19. The method of claim 18 wherein the reductive atmosphere comprises ammonium gas, cracked ammonia gas, or a mixture thereof.

20. The method of claim 17 wherein the infiltrating material comprises copper, and wherein the infiltration temperature is between about 1080° C. to about 1100° C.

21. The method of claim 17 further comprising tempering the quenched sintered alloy, wherein the quenching comprises oil quenching at a temperature of from about 850° C. to about 880° C. for 30 to 45 minutes.

22. The method of claim 17 further comprising tempering the quenched sintered alloy, wherein the tempering comprises maintaining the sintered alloy at a temperature of from about 590° C. to about 610° C.

23. The method of claim 17 wherein the substantially homogenous mixture further comprises iron or an iron alloy different than the Fe—Co—Ni—Mo alloy powder, wherein the iron or an iron alloy form on sintering a sorbite structure with the Fe—Co—Ni—Mo alloy powder, Cr—W—Co—C alloy powder, vanadium carbide powder, and graphite powder dispersed therein.

24. The method of claim 17 wherein the sintered alloy comprises:

Fe, between about 1.0 to about 1.5 weight % of C, between about 1 to about 3 weight % of Ni, between about 6 to about 11 weight % of Cr, between about 1 to about 3 weight % of Mo, between about 5 to about 11 weight % of Co, between about 1 to about 3 weight % of W, between about 0.5 to about 1.0 weight % of V, and between about 11 to about 18 weight % of an infiltrating material comprising Cu.

25. The method of claim 24, wherein the Fe—Co—Ni—Mo alloy particles contain an alloy comprising about 86 to about 93 weight % of Fe, about 5 to about 8 weight % of Co, about 1 to about 3 weight % of Ni, and about 1 to about 3 weight % of Mo;

wherein the Cr—W—Co—C alloy particles contain an alloy comprising about 48 to about 80 weight % of Cr, about 8 to about 25 weight % of W, about 10 to about 25 weight % of Co, and about 1 to about 3 weight % of C;

wherein a surface pressure of from 5 to 8 ton/cm$^2$ is applied prior to and/or during sintering, and the sintering is performed at a temperature of from about 1160° C. to about 1200° C. under a reductive atmosphere comprising ammonium gas, cracked ammonia gas, or a mixture thereof;

wherein the infiltrating material comprises copper, and the infiltration temperature is between about 1080° C. to about 1100° C.;

wherein the quenching comprises oil quenching at a temperature of from about 850° C. to about 880° C. for 30 to 45 minutes;

and further comprising tempering the quenched sintered alloy, wherein the tempering comprises maintaining the sintered alloy at a temperature of at least about 590° C. for at least about 2 hours.

* * * * *